United States Patent [19]

Brenan

[11] 4,205,532

[45] Jun. 3, 1980

[54] APPARATUS FOR AND METHOD OF TRANSFERRING HEAT

[75] Inventor: Anthony M. Brenan, Salisbury, England

[73] Assignee: Commercial Refrigeration (Wiltshire) Limited, Salisbury, England

[21] Appl. No.: 900,787

[22] Filed: Apr. 28, 1978

[30] Foreign Application Priority Data

May 2, 1977 [GB] United Kingdom ..... 18272/77

[51] Int. Cl.[2] ..... F25B 1/00; F25B 27/02

[52] U.S. Cl. ..... 62/115; 62/114; 62/238; 62/467 R; 62/498

[58] Field of Search ..... 62/114, 115, 498, 238 E, 62/260, 467

[56] References Cited

U.S. PATENT DOCUMENTS

| | | | |
|---|---|---|---|
| 2,219,815 | 10/1940 | Jones | 62/238 E |
| 2,778,607 | 1/1957 | Leoni | 62/238 E |
| 3,234,738 | 2/1966 | Cook | 62/238 E |
| 3,400,555 | 9/1968 | Granryd | 62/498 |
| 3,513,663 | 5/1970 | Martin, Jr. et al. | 62/238 E |
| 3,597,183 | 8/1971 | Murphy | 62/114 |
| 3,872,682 | 3/1975 | Shook | 62/114 |
| 4,019,679 | 4/1977 | Vogt et al. | 62/238 E |

*Primary Examiner*—Lloyd L. King
*Attorney, Agent, or Firm*—Brumbaugh, Graves, Donohue & Raymond

[57] ABSTRACT

A known type of heat pump or refrigeration apparatus comprises a closed circuit containing a refrigerant, the closed circuit comprising an acceptor for heat exchange between the refrigerant and a first body of a fluid or other substance, a compressor for compressing the refrigerant from the acceptor, a rejector for heat exchange between the compressed refrigerant and a second body of a fluid or other substance, and an expansion device to expand the refrigerant from the rejector before it is directed back to the acceptor. In the known apparatus, the refrigerant is at subcritical pressure at all places in the closed circuit. In contrast, in the circuit of apparatus embodying the invention, whereas the refrigerant in the acceptor remains at a subcritical pressure, the refrigerant in the rejector is at supercritical pressure. This enables the entropy gain in the rejector to be substantially reduced and the thermodynamic efficiency (and also the coefficient of performance) to be increased. Further, the inventive thermodynamic cycle permits the use of refrigerants of low compression ratios, in particular carbon dioxide ($CO_2$) or ethane ($C_2H_6$), which enables the compression efficiency to be increased.

6 Claims, 4 Drawing Figures

APPARATUS FOR AND METHOD OF TRANSFERRING HEAT

BACKGROUND OF THE INVENTION

1. Field of the invention

This invention relates to apparatus for and methods of transferring heat.

2. Description of the prior art

Heat pumps for providing sensible heating of a fluid or other substance are known. They function by accepting heat from a source which is at a relatively low temperature and rejecting the heat at a relatively high temperature to the fluid or other substance to be heated. The source will generally be a large body of some substance at a nominally constant temperature, for example the sea, a lake, a tank or pool of water, atmospheric air, the ground, a flowing fluid, a condensing fluid or a solid. Known heat pumps of this kind comprise a closed circuit containing a refrigerant. The closed circuit comprises: a first heat exchanger (hereinafter referred to as an acceptor) for heat exchange between the source and refrigerant to heat the refrigerant; a compressor for receiving the refrigerant from the acceptor and raising its temperature by the addition of mechanical work; a second heat exchanger (hereinafter referred to as a rejector) for heat exchange between the refrigerant from the compressor and the substance to be heated; and an expansion device connected between the rejector and the acceptor to cool the refrigerant from the rejector to below the source temperature.

The above-described known heat pumps generally employ a refrigerant which is at a subcritical pressure throughout the thermodynamic cycle, that is to say at all places in the closed circuit. The refrigerant accepts heat by two-phase boiling or evaporation and rejects heat by three processes, namely gas de-superheating, two-phase condensation and liquid subcooling. Consideration of the thermodynamic efficiency of the known heat pumps shows that there are two major causes of inefficiency, namely (i) entropy gain in the rejector and (ii) non-isentropic compression of the refrigerant.

OBJECTS OF THE INVENTION

A major object of the invention is to provide an apparatus and/or method of transferring heat which is an improvement over the prior art as described above.

A more specific object of the invention is to provide an apparatus and/or method of transferring heat in which the thermodynamic efficiency is improved as compared to the prior art as described above.

Another object of the invention is to provide an apparatus and/or method of transferring heat in which the coefficient of performance is improved as compared to the prior art as described above.

A further object of the invention is to provide an apparatus and/or method of transferring heat which is an improvement over the prior art as described above in that the thermodynamic efficiency is improved by reducing the entropy gain in the rejector.

Yet another object of the invention is to provide an apparatus and/or method of transferring heat which is an improvement over the prior art as described above in that the thermodynamic efficiency is improved by improving the compression efficiency.

SUMMARY OF THE INVENTION

The invention provides apparatus for transferring heat. The apparatus comprises a closed circuit that contains a refrigerant. The closed circuit comprises an acceptor for heat exchange between the refrigerant and a first body of a fluid or other substance, a compressor for compressing the refrigerant from the acceptor, a rejector for heat exchange between the compressed refrigerant and a second body of a fluid substance, and an expansion device to expand the refrigerant from the rejector before it is directed back to the acceptor.

As is the case for the known heat pumps described above, the refrigerant in the acceptor of the apparatus of the invention is at a subcritical pressure whereby it accepts heat by two-phase boiling or evaporation. However, in the apparatus of the invention the refrigerant rejects heat at a supercritical pressure, whereby the entropy gain in the rejector can be substantially reduced and the thermodynamic efficiency of the apparatus increased. Further, the adoption of the thermodynamic cycle employed in the present invention permits the use of refrigerants of low compression ratios, in particular carbon dioxide ($CO_2$) or ethane ($C_2H_6$), which enables increase of the compression efficiency.

Rather than being concerned with the thermodynamic efficiency of a heat pump, the user is mainly concerned with its coefficient of performance (COP) or performance energy ratio, as it is frequently termed in contemporary literature. However, as will be demonstrated below, the coefficient of performance is very much dependent on the thermodynamic efficiency, whereby the improved thermodynamic efficiency that can be provided by apparatus embodying the invention can enable the coefficient of performance to be increased.

The invention also provides a method of transferring heat between bodies of fluid or other substance. The method comprises effecting heat exchange between a refrigerant and a first body of a fluid or other substance in such a manner that the refrigerant accepts heat from the first body while the refrigerant is at subcritical pressure, compressing the refrigerant heated by the first body, effecting heat exchange between the compressed refrigerant and a second body of a fluid substance in such a manner that the refrigerant rejects heat to the second body while the refrigerant is at supercritical pressure, and expanding the refrigerant that has rejected heat to the second body before subjecting it again to said heat exchange with the first body.

The inventive method provides the same advantages as the inventive apparatus, as set forth above.

As is known to those skilled in the art, there is no basic difference in either the principal components or operating cycle between a vapor compression heat pump and a vapour compression refrigeration plant, though there may of course be differences in design. THey both function to transfer heat from a first body to a second body, the first body thereby losing heat and the second body being sensibly heated, the main difference being that in a refrigeration plant the user's interest is mainly in the heat accepting (i.e. cooling) side, whereas in a heat pump the user's interest is mainly in the heat rejecting (i.e. heating) side. Thus, while an apparatus in accordance with the invention may be specifically designed as a heat pump for sensible heating of the second body, it will nevertheless function to remove heat from the first body whereby, depending to some extent on its manner of use, it can also function as a refrigeration plant. The invention includes within its scope apparatus specifically designed to function as a heat pump, as a refrigeration apparatus, or simultaneously as both. For the sake of convenience only the heat pump case will be disclosed in detail hereinbelow.

An embodiment of the invention will now be described, by way of example, with reference to the accompanying drawings.

DETAILED DESCRIPTION OF THE PREFERRED EMBODIMENT

Figure 1:
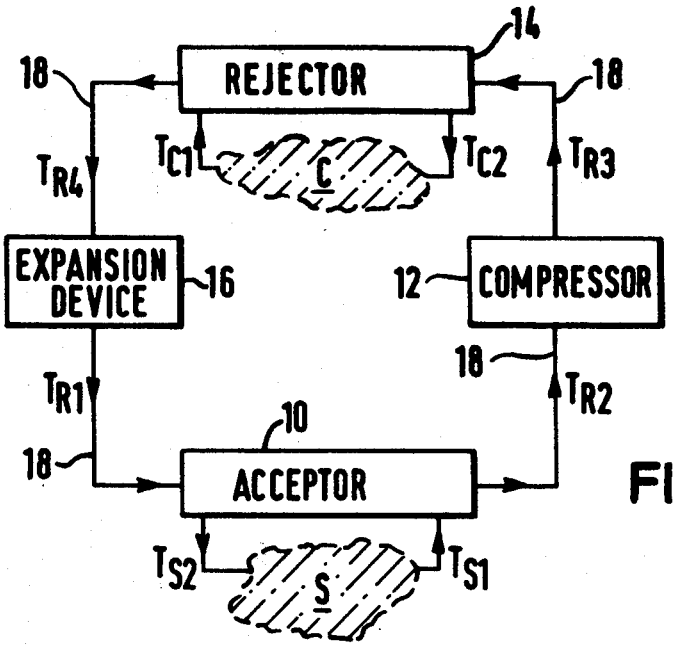
FIG. 1 is a schematic block diagram of a heat pump.

Referring first to FIG. 1, the heat pump shown therein is for "pumping" heat from a source S to a fluid substance C to provide sensible heating of the latter. For convenience, both the source S and the substance C will hereinafter be considered to be fluid and will be referred to hereinafter as the source fluid and coolant. However, the heat pump can also be employed in those cases where the source is a solid.

The illustrated heat pump comprises an acceptor 10, a compressor 12, a rejector 14 and an expansion device 16 connected together, as shown, by lines 18 to constitute a closed circuit, the closed circuit containing a refrigerant.

The acceptor 10 is illustrated as being a counter-current heat exchanger. The source fluid S enters the acceptor 10 at a temperature $T_{S1}$ and leaves it at a temperature $T_{S2}$. The refrigerant enters the acceptor 10 at a temperature $T_{R1}$ and accepts heat from the source fluid S, leaving the acceptor at a temperature $T_{R2}$. In the acceptor 10 the refrigerant is at a subcritical pressure: it accepts heat from the source fluid S by two-phase boiling or evaporation. It is not essential that the acceptor 10 be a counter-current heat exchanger. Since, usually, only small temperature differences exist between the source fluid S and the refrigerant in the acceptor 10, cross-flow or other heat exchanger designs may be employed without significant loss in efficiency.

The compressor 12 compresses the refrigerant leaving the acceptor 10 and, by subjecting the refrigerant to mechanical work, raises the pressure of the refrigerant and raises its temperature from $T_{R2}$ to $T_{R3}$.

The rejector 14 is a counter-current heat exchanger. The coolant C enters the rejector 14 at a temperature $T_{C1}$ and leaves it at a temperature $T_{C2}$. The refrigerant rejects heat to the coolant in the rejector 14 and leaves the rejector at a temperature $T_{R4}$.

The expansion device 16 expands the refrigerant leaving the rejector 16 thereby to reduce its temperature to the temperature $T_{R1}$ and to reduce its pressure.

Figure 2:
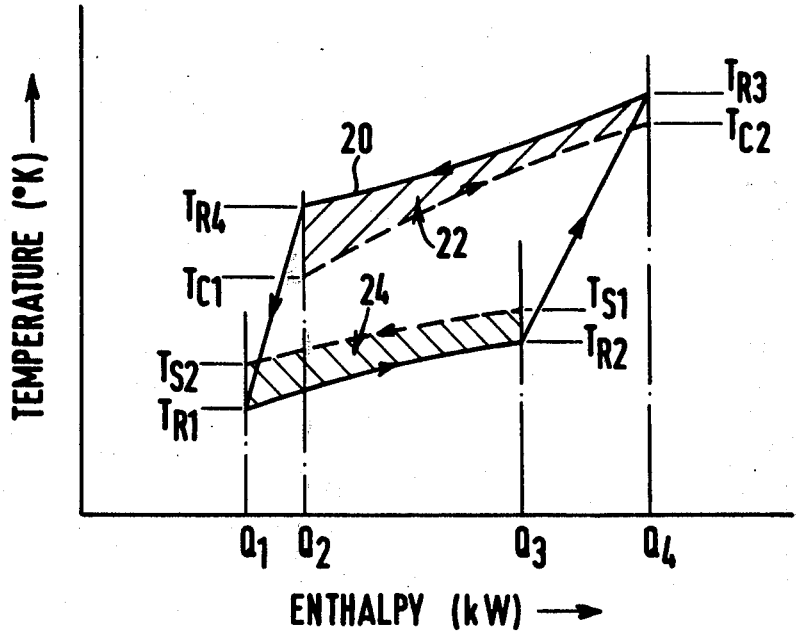
FIG. 2 is a temperature/enthalpy diagram illustrating the thermodynamic cycle executed by the heat pump shown in FIG. 1.

FIG. 2 is a temperature/enthalpy diagram (temperature in degrees Kelvin, enthalpy in kilowatts) for the refrigerant and illustrates in graphic form by a closed, solid line 20 the thermodynamic cycle executed by the heat pump as described above. The enthalpy values $Q_1$, $Q_2$, $Q_3$ and $Q_4$ are the values for the enthalpy of the refrigerant where it enters the acceptor 10, leaves the rejector 14, leaves the acceptor 10, and enters the rejector 14, respectively. Temperature and enthalpy losses along the lines 18 have been neglected as being insignificant.

In a conventional heat pump the refrigerant in the rejector 14 is at subcritical pressure. In contrast, in a heat pump embodying the invention the refrigerant in the rejector 14 is at supercritical pressure, whereby, as is explained below, the entropy gain in the rejector can be substantially reduced and the thermodynamic efficiency of the heat pump increased. The thermodynamic cycle employed in a heat pump embodying the invention permits the use of refrigerants of low compression ratios, for example carbon dioxide ($CO_2$) or ethane ($C_2H_6$), which enables increase of the compression efficiency, as is explained below.

A heat pump embodying the invention may be constructed along the same lines as a conventional heat pump, with the following exceptions.

(i) The compressor 12 must be sufficiently powerful to impart a supercritical pressure to the refrigerant in the rejector 14; and the expansion device 16 must provide a sufficient degree of throttling to reduce the pressure of the refrigerant to a suitable subcritical value before it enters the acceptor.

(ii) Conventional heat pumps are designed for a maximum refrigerant working pressure of 300 psia. Since the critical pressures of virtually all fluids exceed 450 psia, the critical pressures of carbon dioxide and ethane, in particular, being 1071 psia and 708 psia, respectively, the heat pump of FIG. 1 is designed to withstand the correspondingly higher refrigerant working pressures to which it will be subjected.

(iii) The rejector (condenser) of a conventional heat pump is designed so that the refrigerant flows therethrough in a horizontal or downward direction so that liquid refrigerant cannot be trapped therein. Since the refrigerant in the rejector 14 of the heat pump of FIG. 1 is at supercritical pressure the rejector 14 is not subject to this design restriction, because, apart from any compressor lubricating oil entrained in the refrigerant, the refrigerant in the rejector is a single-phase fluid whereby there is no requirement to allow for liquid drainage through the rejector.

A heat pump embodying the invention may be employed in a variety of applications, for instance to heat water from, say 5° C. to 100° C. (boiling point) or to heat air from, say, 20° C. to 60° C. More generally, the heat pump can be employed to heat a fluid or other substance to a temperature in excess of the critical temperature of the refrigerant employed. The critical temperatures of carbon dioxide and ethane are 31° C. and 32.2° C., respectively.

As mentioned above, the thermodynamic cycle executed by the heat pump of FIG. 1 is shown in FIG. 2. Now the thermodynamic efficiency $\eta$ of the heat pump shown in FIG. 1 is equal to the ratio of the entropy (in kW/deg K) lost by the source fluid S in flowing through the acceptor (i.e. in dropping in temperature from $T_{S1}$ to $T_{S2}$) to the entropy (in kW/deg K) gained by the coolant C in flowing through the rejector (i.e. in rising in temperature from $T_{C1}$ to $T_{C2}$). Thus, in mathematical terms, the thermodynamic efficiency $\eta$ can be expressed as:

$$\eta = \frac{\int_{Q_1}^{Q_3} \frac{dQ}{T_S}}{\int_{Q_2}^{Q_4} \frac{dQ}{T_C}} \quad (1)$$

where $T_S$ and $T_C$ are the source fluid and coolant temperatures, respectively, in deg K.

If $\phi_A$ is the gain in entropy of the refrigerant in the acceptor (i.e. in rising in temperature from $T_{R1}$ to $T_{R2}$), the numerator of equation (1) may be written as $$\phi_A - \int_{Q_1}^{Q_3} \left( \frac{1}{T_R} - \frac{1}{T_S} \right) dQ \quad (2)$$

where $T_R$ is the refrigerant temperature in deg K.

If $\phi_R$ is the loss in entropy ($\phi_R$ will be $\geqq \phi_A$) of the refrigerant in the rejector (i.e. in dropping in temperature from $T_{R3}$ to $T_{R4}$), the denominator of equation (1) may be written as $$\phi_R + \int_{Q_2}^{Q_4} \left( \frac{1}{T_C} - \frac{1}{T_R} \right) dQ \quad (3).$$

The thermodynamic efficiency $\eta$ may be thus written in dimensionless quantities as $$\eta = \frac{1 - \frac{1}{\phi_A} \int_{Q_1}^{Q_3} \frac{1}{T_R T_S} (T_S - T_R)\, dQ}{\frac{\phi_R}{\phi_A} + \frac{1}{\phi_A} \int_{Q_2}^{Q_4} \frac{1}{T_C T_R} (T_R - T_C)\, dQ} \quad (4)$$

Equation (4) shows the way in which the thermodynamic efficiency is made up of the entropy changes $\phi_A$ and $\phi_R$ experienced by the refrigerant in the acceptor and the rejector, respectively, as it goes round the cycle, and integral quantities which represent entropy gains due to heat transfer in the acceptor and rejector, respectively.

Since the factors $1/T_R T_S$ and $1/T_C T_R$ in equation (4) are each roughly constant, due to the fact that the absolute values of the temperatures are generally large compared with the variations they experience in the cycle, the integral quantities are approximately proportional to the areas of the cross-hatched regions 22, 24 in FIG. 2, which relate to the rejector and acceptor heat exchange processes, respectively. By making the reasonable assumption that the refrigerant temperature $T_R$ and source fluid temperature $T_S$ are virtually constant in the acceptor, the integral quantity in the numerator of Equation (4) may be solved. The numerator of Equation (4) then becomes $$1-(T_S-T_R)/T_S$$

For example, if $T_S=273°$ K. and $T_R=268°$ K., $(T_S-T_R)/T_S=0.0183$, that is to say the numerator of Equation (4) is substantially unity. Thus, it is apparent that the acceptor contributes to a negligible extent to thermodynamic inefficiency and that in fact the major causes of inefficiency are to be found in the denominator of Equation 4.

In a heat pump embodying the invention the effects of these causes of inefficiency are minimised by the following features.

(i) The adoption of a thermodynamic cycle in which supercritical pressure is attained permits the use of refrigerants with low compression ratios, e.g. $CO_2$ or $C_2H_6$, which provides high compression efficiency.

(ii) The entropy gain that occurs in the rejector 14 is substantially reduced due to the refrigerant in the rejector being at supercritical pressure.

Figure 3:
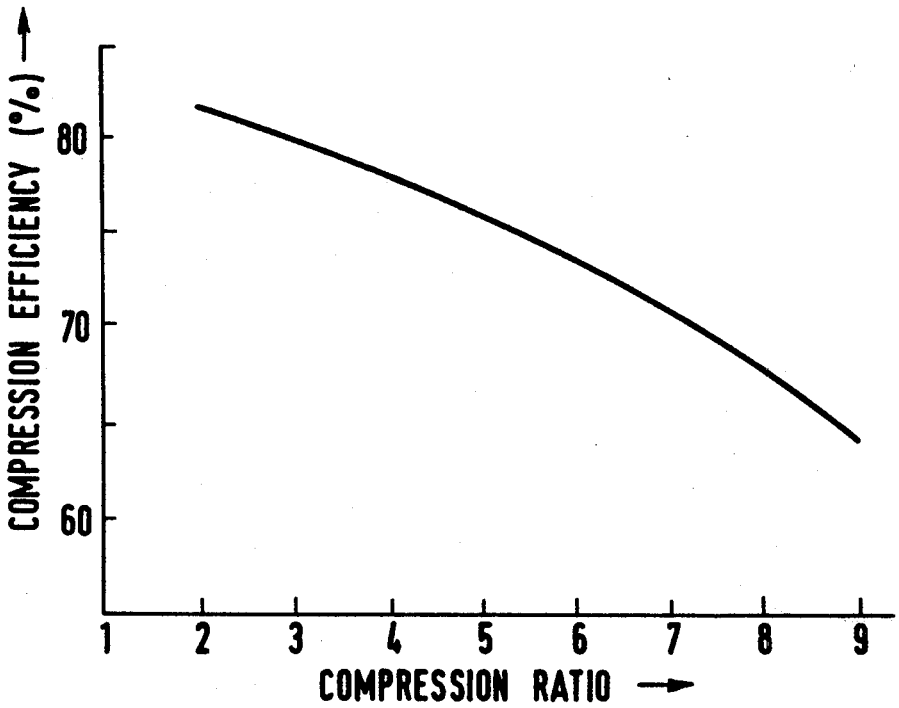
FIG. 3 is a graph of percentage compression efficiency against compression ratio for a typical gas compressor.

Feature (i) can be more clearly appreciated from FIG. 3, which is a graph of percentage compression efficiency against compression ratio for a typical gas compressor and shows that high compression efficiency may be obtained with low compression ratio. The compression efficiency is defined as the ratio of the isentropic work of compression to the actual work of compression.

Figure 4:
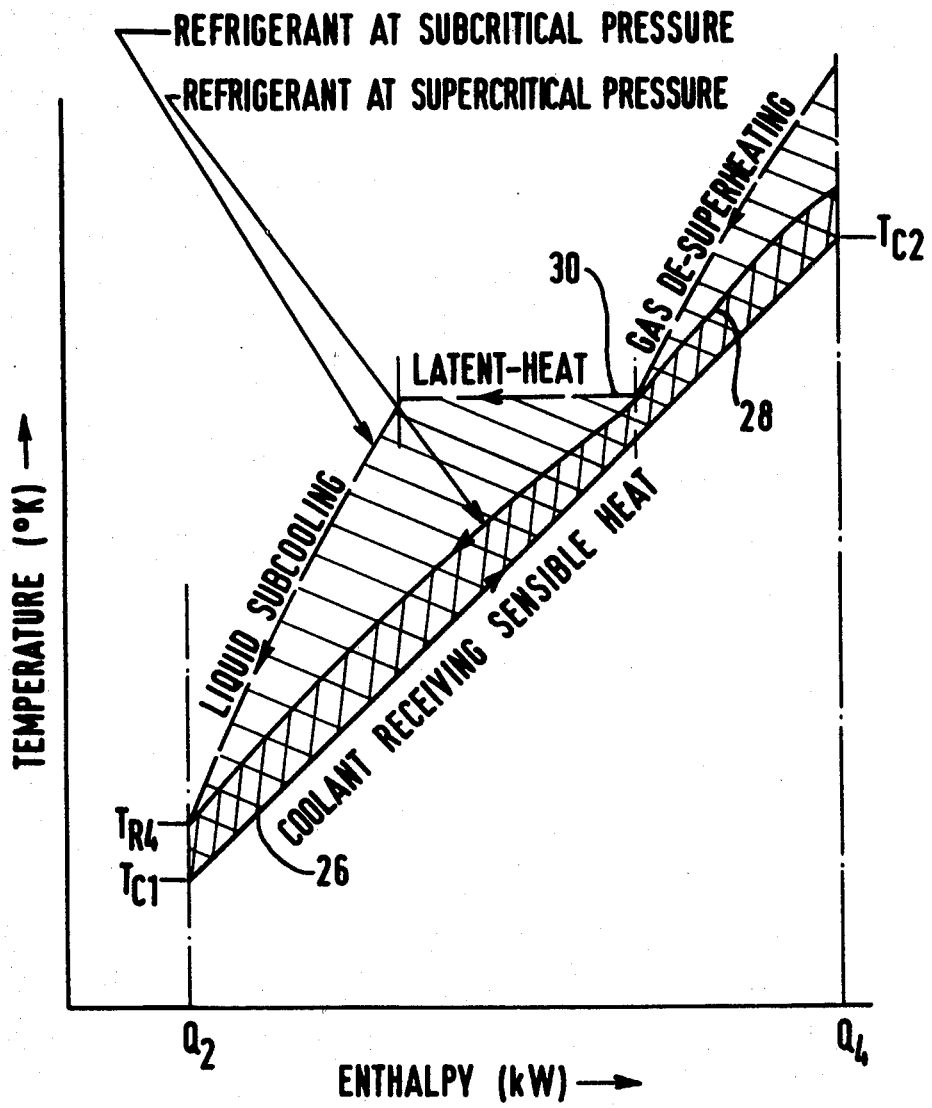
FIG. 4 is a temperature/enthalpy diagram illustrating the heat rejection process carried out in the rejector of a heat pump embodying the invention, in which the refrigerant rejects heat at supercritical pressure, the heat rejection process carried out in the rejector of a known heat pump in which the refrigerant rejects heat at subcritical pressure also being represented for purposes of comparison.

Feature (ii) can be more clearly appreciated from an inspection of FIG. 4, which illustrates the heat rejection process in the rejector 14 of a heat pump embodying the invention, in which the refrigerant is at supercritical pressure, and the corresponding process in the rejector of a like, known heat pump in which the refrigerant is at subcritical pressure and in which the refrigerant rejects heat by gas de-superheating, two-phase condensation (giving up its latent heat) and liquid sub-cooling. In the rejector 14 of the heat pump embodying the invention the entropy gain is approximately proportional to the cross-hatched area between a pair of lines 26 and 28, whereas in the rejector of the known heat pump the entropy gain is approximately proportional to the considerably larger cross-hatched area between the line 26 and a line 30.

As mentioned hereinabove, the user of a heat pump is more interested in its Coefficient of Performance (COP) than in its thermodynamic efficiency. The COP is defined as $$COP = \frac{\text{rejected enthalpy (kW)}}{\text{compression enthalpy (kW)} - \text{expansion enthalphy (kW)}} = \frac{Q_4 - Q_2}{(Q_4 - Q_3) - (Q_2 - Q_1)} \quad (5)$$

It should be noted that the expansion enthalpy is not generally available in practical heat pump designs to reduce the work done in the compression process. The expansion enthalpy is usually small compared with the compression enthalpy. Practical expansion devices usually operate on a constant enthalpy basis, whereby $Q_2=Q_1$.

A relationship between thermodynamic efficiency ($\eta$) and Coefficient of Performance (COP) may be derived from Equation (1) on the assumption that the rate of change of temperature with respect to enthalpy (dT/dQ) for both the source fluid S and the coolant C is constant. On this assumption, Equation (1) can be transformed to $$\eta = \frac{(T_{C2} - T_{C1}) \log_e T_{S1}/T_{S2} \left( 1 - \frac{1}{COP} \right)}{(T_{S1} - T_{S2}) \log_e T_{C2}/T_{C1}} \quad (6)$$

Since the ratio $T_{S1}/T_{S2}$ is usually approximately equal to unity, Equation (6) can be shortened to $$\eta = \frac{(T_{C2} - T_{C1})\left(1 - \frac{1}{COP}\right)}{T_S \log_e T_{C2}/T_{C1}} \quad (7)$$

For example, if
$T_{C2}=100°$ C.$=373°$ K.,
$T_{C1}=5°$ C.$=278°$ K., and
$T_S=0°$ C.$=273°$ K., $$\text{then } \eta = 1.1834\left(1 - \frac{1}{COP}\right)$$

whereby the following table may be drawn up:

| COP | $\eta$ |
|---|---|
| 6.45 | 1 |
| 6 | 0.986 |
| 5 | 0.946 |
| 4 | 0.887 |
| 3 | 0.789 |
| 2 | 0.591 |
| 1 | 0 |

As a second example, if
$T_{C2}=60°$ C.$=333°$ K.,
$T_{C1}=20°$ C.$=293°$ K., and
$T_S=0°$ C.$=273°$ K., $$\text{then } \eta = 1.1440\left(1 - \frac{1}{COP}\right)$$

and the following table may be drawn up:

| COP | $\eta$ |
|---|---|
| 7.94 | 1 |
| 7 | 0.981 |
| 6 | 0.953 |
| 5 | 0.915 |
| 4 | 0.858 |
| 3 | 0.763 |
| 2 | 0.572 |
| 1 | 0 |

The above tables show that the Coefficient of Performance is acutely dependent on the thermodynamic efficiency ($\eta$). Accordingly, the increased thermodynamic efficiency of the heat pump embodying the invention results in an increased Coefficient of Performance.

In the light of the above disclosure of an exemplary embodiment of the invention, various changes and modifications will suggest themselves to those skilled in the art. It is intended that all such changes and modifications shall fall within the spirit and scope of the invention as defined in the appended claims.

I claim:

1. Apparatus for transferring heat, said apparatus comprising a closed circuit that contains a refrigerant, said closed circuit comprising:

(a) an acceptor operative to effect heat exchange between said refrigerant and a first body of a fluid or other substance;

(b) a compressor operative to compress and capable of compressing refrigerant emerging from said acceptor to an extent such that the refrigerant is raised to a supercritical pressure and is therefore in a wholly gaseous state;

(c) a rejector capable of withstanding refrigerant at supercritical pressure and connected to receive the compressed refrigerant from said compressor, the rejector being operative to effect counter-current heat exchange between the compressed refrigerant and a second body of a fluid substance whereby said heat exchange is effected whilst the refrigerant is at supercritical pressure and therefore in a wholly gaseous state and whereby the fluid substance is sensibly heated and its temperature is raised; and (d) an expansion device operative to expand the refrigerant from said rejector to an extent such that the refrigerant is expanded to a subcritical pressure before it is directed back to said acceptor, whereby said heat exchange effected by said acceptor is effected whilst the refrigerant is at subcritical pressure.

2. Apparatus according to claim 1, wherein said refrigerant is carbon dioxide.

3. Apparatus according to claim 1, wherein said refrigerant is ethane.

4. A method of transferring heat, said method comprising effecting heat exchange between a refrigerant and a first body of a fluid or other substance in such a manner that the refrigerant accepts heat from the first body while the refrigerant is at subcritical pressure, compressing the refrigerant heated by said first body to an extent such that the refrigerant is raised to a supercritical pressure and is therefore in a wholly gaseous state, effecting counterflow heat exchange between the compressed refrigerant and a second body of a fluid substance in such a manner that the refrigerant rejects heat to said second body while the refrigerant is at supercritical pressure and therefore in a wholly gaseous state and the fluid substance is sensibly heated and its temperature is raised, and expanding the refrigerant that has rejected heat to said second body to a subcritical pressure before subjecting it again to said heat exchange with said first body.

5. A method according to claim 4, wherein the refrigerant employed is carbon dioxide.

6. A method according to claim 4, wherein the refrigerant employed is ethane.

* * * * *